United States Patent [19]

Ward

[11] 3,982,290

[45] Sept. 28, 1976

[54] MATTRESS EDGE STIFFENER

[76] Inventor: James T. Ward, 1418 N. Potrero Ave., South El Monte, Calif. 91733

[22] Filed: May 8, 1975

[21] Appl. No.: 575,979

[52] U.S. Cl. ..... 5/260; 5/351

[51] Int. Cl.[2] ..... H47C 23/02

[58] Field of Search ..... 5/260, 261, 345 B, 351; 297/456

[56] References Cited

UNITED STATES PATENTS

| | | | |
|---|---|---|---|
| 3,305,879 | 2/1967 | Krakauer | 5/261 X |
| 3,351,964 | 11/1967 | Anson | 5/345 B |
| 3,397,914 | 8/1968 | Richardson | 5/260 X |
| 3,426,371 | 2/1969 | Robinson | 5/260 |

*Primary Examiner*—Casmir A. Nunberg
*Assistant Examiner*—Andrew M. Calvert
*Attorney, Agent, or Firm*—Lyon & Lyon

[57] ABSTRACT

Disclosed herein is an edge stiffener for mattresses. The stiffener is of single piece construction and includes a pair of oppositely projecting lateral mounting arms which are adapted to be carried by the upper and lower border wires of the mattress and which bend at their inner ends to define a corresponding pair of angularly disposed cantilever spring portions joined in a centrally disposed anchor loop.

6 Claims, 3 Drawing Figures

MATTRESS EDGE STIFFENER

BACKGROUND OF THE INVENTION

The standard mattress is generally comprised of upper and lower border wires which extend about the perimeter portion of the mattress; a plurality helical support springs disposed throughout the mattress, the outermost springs being secured at their upper and lower ends to the border wires; one or more layers of padding disposed over the springs and a covering material. While this construction provides comfortable and adequate support for persons lying on the mattress, it provides little or no support about the edge portions thereof. Consequently, when a person sits on or near the edge of the mattress, the supporting structure is stressed and deformed to such an extend that repeated sitting will result in damage to the structural elements of the mattress.

To increase the structural support of mattresses about the edge portions thereof, a new mattress was developed which included a third border wire disposed between the upper and lower wires, which as with the upper and lower wires is held by the outermost helical supporting springs. This structure which is the subject of U.S. Letters Pat. No. 3,256,535, while adding some additional structural strength to the edge portions of a mattress, is nevertheless lacking in sufficient strength to adequately support a person sitting on the edge of a mattress. As a result, repeated sitting on the mattress has still been found to cause deterioration of the edge portions thereof. In view of the fact that people will continue to sit on mattresses, regardless of any warnings by the manufacturers thereof, it would be highly desirable to provide a simple and economical stiffener which could be secured at the various locations about the edge portions of the mattress to provide those portions with sufficient strength to support a person sitting thereon and thereby prevent the aforesaid deterioration of the mattress.

SUMMARY OF THE INVENTION

Briefly, the invention comprises a stiffener which is adapted to be secured to the edge portion of the mattress to increase the structural strength thereof. The stiffener includes extended portions which are secured to the upper and lower border wires of the mattress and a pair of cantilever spring portions which terminate in a central anchor loop which when used with mattresses of the type having a central border wire, extends about the intermediary border wire and is held in place thereby. The stiffener resists compression of the upper and lower border wires through the isolated actions of the cantilever spring portions extending from the central anchor loop.

It is the principal object of the present invention to provide a stiffening member for adding additional strength to the edge portions of mattresses.

It is another object of the present invention to provide a stiffening member which is particularly adapted for adding strength to the edge portions of mattresses of the type having intermediary border wires.

It is a still further object of the present invention to provide a stiffening member for adding strength to the edge portions of mattresses which is of simple construction and easy to install.

These and other objects and advantages of the present invention will become apparent from the following detailed description taken in conjunction with the accompanying drawings.

DESCRIPTION OF A PREFERRED EMBODIMENT

Figure 1:
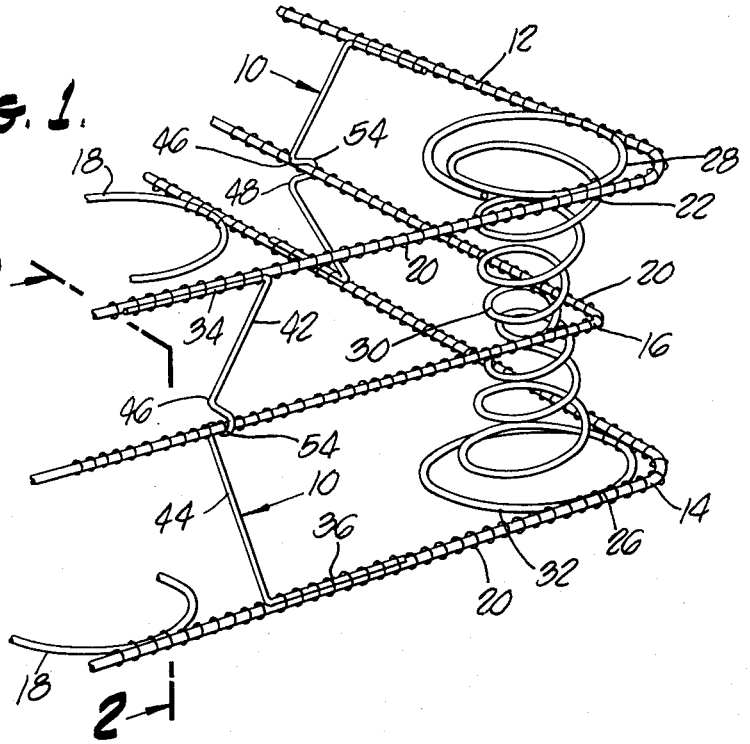
FIG. 1 is an enlarged partial view of the inner spring unit of a mattress to which the mattress edge stiffener has been applied.

Referring now in detail to the drawings, while the edge stiffener 10 of the present invention is suitable for mattresses of standard construction, it is particularly adapted for and shown in the drawings as being used with a mattress of the type having an upper border wire 12, lower border wire 14, intermediate border wire 16, and helical springs 18. It should be noted that the intermediate border wire 16 is inset from the upper and lower border wires which define the sides of the mattress. The upper, lower and intermediate wires are provided with helical wires 20 which are wrapped thereabout and twisted about a turn of the helical support spring 18 at 22, 24 and 26 of the top turn 28, an intermediate turn 30 and lower turn 32, respectively, of the coil springs.

Figure 2:
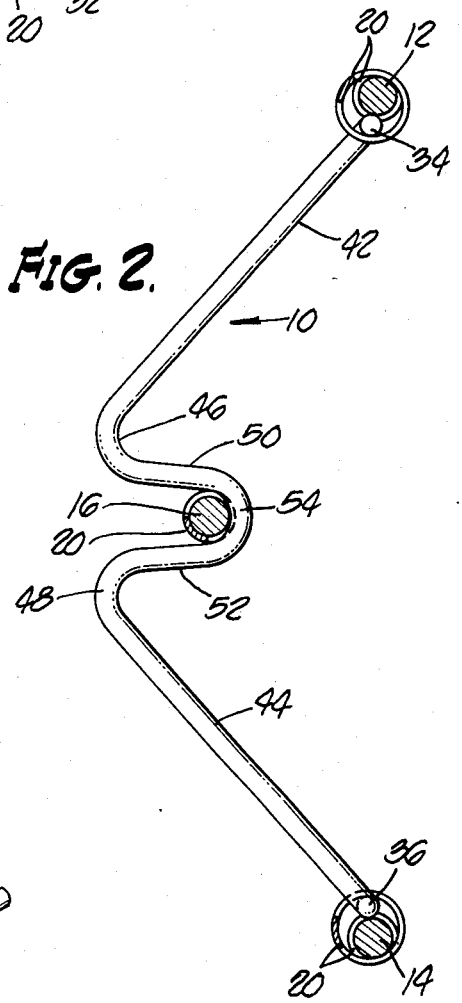
FIG. 2 is a sectional view taken along Line 2 — 2 of FIG. 1.
Figure 3:
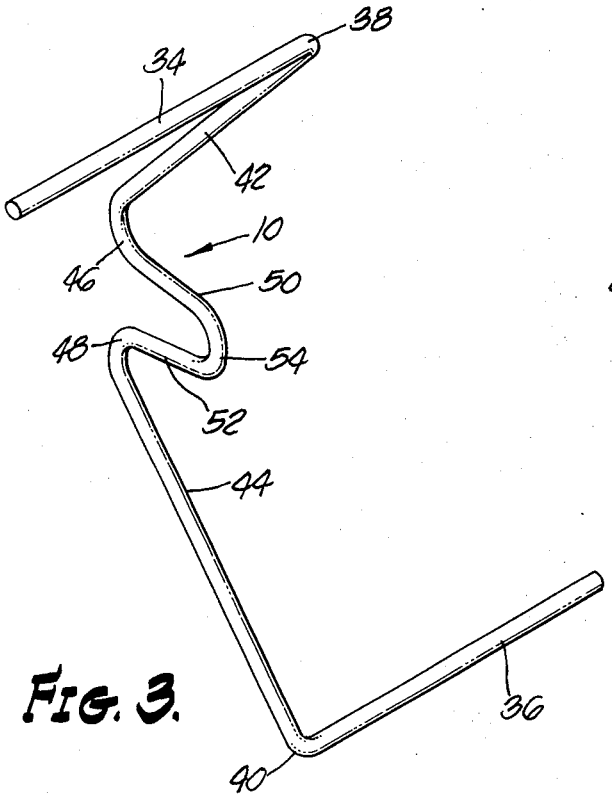
FIG. 3 is a perspective view of the mattress edge stiffener.

The preferred embodiment of the edge stiffener 10 is clearly illustrated in FIGS. 2 and 3 and is seen to be comprised of a pair of parallel oppositely projecting laterial mounting arms 34 and 36, which are bent at 38 and 40 into a corresponding pair of angularly disposed cantilever spring portions 42 and 44. The spring portions, while being angularly disposed from the mounting arms in a vertical plane, extend therefrom at substantially right angles into bends 46 and 48 from which they extend in short substantially parallel sections 50 and 52. The inner ends of the cantelever spring portions 42 and 44 of the edge stiffener are then joined in an anchor loop 54.

In use, the mounting arms 34 and 36 of the stiffener 10 are secured to the upper and lower border wires 12 and 14, respectively, by the helical wire 20 wrapped thereabout and the anchor loop 54 is extended about the intermediary border wire 16, as shown in FIG. 1. It can be seen that when pressure is exerted on the mattress edge, such as might be caused by a person sitting thereon, the resulting bending of the cantilever spring portions tends to urge the anchor loop 54 in an outwardly direction. However, the anchor loop is prevented from undergoing such movement by the intermediary border wire 16 of the mattress. Consequently, the stiffener 10 in such an installation is increasingly effective in providing a double cantelever spring action, which tends to maintain the upper and lower border wires in their predetermined spaced position. In this manner, the stiffener provides sufficient support to the edge portion of a mattress to support a person sitting thereon to prevent overloading of the mattress structure.

While other mattress stiffeners, such as that disclosed in U.S. Letters Pat. No. 3,305,879, are currently available for use in mattresses not incorporating an intermediary strengthening border wire, it has been found that the stiffening member 10, while being more economical due to the simplified construction thereof, provides superior support to those stiffeners heretofore available, and when used in the above-described environment, provides even greater edge support for the mattress, thereby both reducing the number of stiffeners which need to be used to provide adequate edge support and allowing the mattress border wires to be constructed of a lighter gage material.

It is to be understood that the above description is of the preferred embodiment of the invention and that changes in the proportion and exact shapes of the various elements of the stiffener might be varied depending on the mattress to which they are to be secured. For example, the configuration of the mounting arms could be greatly changed without altering either the principle or the operation of the cantilever spring portions of the stiffener. Various other changes and modifications could be made in carrying out the present invention without departing from the spirit and scope thereof. Insofar as these changes and modifications are within the purview of the appended claims, they are to be considered as part of the invention.

I claim:

1. A single piece edge stiffener for mattresses having means at the extended ends thereof for securing said stiffener to the edge of a mattress, a pair of coplanar cantelever spring portions extending inwardly of said extended ends from each of said securing means and being integrally joined at the inner ends thereof in a substantially semi-circular anchor loop, said anchor loop being open at its inner end and coplanar with said cantelever spring portions and adapted to be disposed about a portion of said mattress.

2. The combination of claim 1 wherein said securing means comprises a pair of oppositely projecting lateral mounting arms, said spring portions extending from and being angularly disposed with respect to said mounting arms.

3. The combination of claim 1 including bends in the inwardly extended portions of said spring portions to define substantially parallel extensions terminating in said anchor loop.

4. A single piece edge stiffener for mattresses of the type having upper, lower and intermediate border wires wherein the intermediate wire is inwardly disposed of the mattress from the upper and lower wires, said stiffener comprising: a pair of oppositely projecting mounting arms at the entended ends thereof, adapted to be carried by the upper and lower border wires of the mattress, respectively; and a corresponding pair of coplanar cantilever spring portions integrally formed with and extending inwardly at corresponding angles from said mounting arms and being integrally joined at the inner ends thereof in a substantially semi-circular anchor loop, said loop being open at its inner end and adapted to be disposed about the intermediate border wire of said mattress.

5. The combination of claim 4 including bends in the inwardly extending portions of said spring portions to define substantially parallel extensions, said extensions terminating in said anchor loop.

6. A single piece edge stiffener for mattresses of the type having upper, lower and intermediate border wires wherein the intermediate wire is inwardly disposed of the mattresses from the upper and lower wires, said stiffener comprising: a pair of oppositely projecting mounting arms at the extended ends thereof adapted to be carried by the upper and lower border wires of the mattress respectively, each of said arms bending at the inner ends thereof, at substantially right angles, to define a pair of coplanar cantilever spring portions, said spring portions extending inwardly of said arms and bending at the inwardly extending ends thereof to define a pair of substantially parallel extensions, said extensions terminating in a semi-circular anchor loop, said anchor loop being open at its inner end and adapted to be disposed about said intermediate border wire of said mattress.

* * * * *